US007319391B2

(12) United States Patent
Lagarde et al.

(10) Patent No.: US 7,319,391 B2
(45) Date of Patent: Jan. 15, 2008

(54) CENTRALISED SECURITY CLOSURE

(75) Inventors: Eric Lagarde, Sallanches (FR); Bernard Pitaud, Annecy (FR); Olivier Poulet, Burdignin (FR)

(73) Assignee: Somfy SAS, Cluses (FR)

( * ) Notice: Subject to any disclaimer, the term of this patent is extended or adjusted under 35 U.S.C. 154(b) by 218 days.

(21) Appl. No.: 10/483,348

(22) PCT Filed: Jul. 10, 2002

(86) PCT No.: PCT/IB02/02693

§ 371 (c)(1),
(2), (4) Date: Jan. 8, 2004

(87) PCT Pub. No.: WO03/007259

PCT Pub. Date: Jan. 23, 2003

(65) Prior Publication Data

US 2004/0163314 A1 Aug. 26, 2004

(30) Foreign Application Priority Data

Jul. 11, 2001 (FR) ..... 01 09560
Feb. 18, 2002 (FR) ..... 02 01988

(51) Int. Cl.
*E05B 45/06* (2006.01)

(52) U.S. Cl. ..... 340/542; 340/541; 340/528; 49/31

(58) Field of Classification Search ..... 340/542, 340/541, 528; 307/10.5; 49/3.1, 31; 70/215
See application file for complete search history.

(56) References Cited

U.S. PATENT DOCUMENTS

| | | | | |
|---|---|---|---|---|
| 4,360,801 | A | 11/1982 | Duhame | 340/521 |
| 4,461,221 | A * | 7/1984 | Schandle et al. | 109/6 |
| 4,563,625 | A | 1/1986 | Kornbrekke et al. | 318/603 |
| 4,755,792 | A | 7/1988 | Pezzolo et al. | 340/538 |
| 4,818,971 | A | 4/1989 | Patrick | 340/543 |
| 4,918,717 | A | 4/1990 | Bissonnette et al. | 379/40 |
| 4,981,084 | A * | 1/1991 | Templeton et al. | 105/341 |

(Continued)

FOREIGN PATENT DOCUMENTS

EP 0 573 388 B1 9/1996

(Continued)

*Primary Examiner*—Anh V. La
(74) *Attorney, Agent, or Firm*—Frommer Lawrence & Haug LLP; Ronald R. Santucci

(57) ABSTRACT

A device of automated closure, and of locking, comprising a mobile closure or locking element (2), an actuator (3) electrically controllable for the motion of the element, a sensor (4), a programming and control device, the program of which comprises at least a mode of delayed action and a unit of transition to that delayed action mode, wherein, when placed in the delayed action mode, the programming and control device delivers a complete closure instruction only on activation of a sensor.

21 Claims, 2 Drawing Sheets

U.S. PATENT DOCUMENTS

| | | | | | |
|---|---|---|---|---|---|
| 5,003,290 | A | | 3/1991 | Lindquist et al. | 340/545 |
| 5,006,766 | A | * | 4/1991 | Yuhas et al. | 318/53 |
| 5,247,232 | A | | 9/1993 | Lin | 318/468 |
| 5,453,736 | A | * | 9/1995 | Noren | 340/5.6 |
| 5,694,867 | A | * | 12/1997 | Diaz-Lopez | 109/6 |
| 5,801,625 | A | | 9/1998 | Wang | 340/506 |
| 5,805,064 | A | * | 9/1998 | Yorkey | 340/550 |
| 5,920,270 | A | | 7/1999 | Peterson | 340/825.37 |
| 6,054,921 | A | | 4/2000 | Miller | 340/541 |
| 6,111,502 | A | | 8/2000 | Lenglart et al. | 340/541 |
| 6,225,903 | B1 | * | 5/2001 | Soloway et al. | 340/542 |
| 6,348,866 | B1 | * | 2/2002 | Arroyo Lopez | 340/573.1 |

FOREIGN PATENT DOCUMENTS

| | | |
|---|---|---|
| EP | 1 054 134 B1 | 5/2000 |
| FR | 2 586 743 | 9/1985 |
| FR | 2 640 671 | 6/1990 |
| GB | 2 296 032 | 6/1996 |
| JP | 6135668 | 5/1994 |

* cited by examiner

CENTRALISED SECURITY CLOSURE

BACKGROUND OF THE INVENTION

The present invention concerns a security closure device for private dwellings or dwellings in collective apartment buildings.

Anti-intrusion security in such premises is usually provided by an alarm system.

Such systems are not generally able to reconcile security and comfort of the occupant. Indeed, for many years, the problematics of the anti-intrusion alarm has been that of protecting premises carefully locked by an owner most often absent at the time of the attempted break-in.

It frequently happens these days that such attempts are carried out despite the presence of the occupant and sometimes totally without his knowledge. This change stems from the emergence of new forms of criminality, regardless of the risks, and from a comprehensible desire for dwellings to be open to the outside, combining architectural style with lifestyle, by means of wide glazed bay windows.

Alarm systems are very effective at detecting and alerting when an individual penetrates a protected zone. Such a zone is protected either by exterior means of detection, or by a locked enclosure fitted with peripheral sensors, or by interior means of detection, or by a combination of these three elements.

The interior means are usually switched off by the occupant when he is present, at least in the zone where he normally moves around. The experience of several false alarms that he will have caused by himself generally prompts the occupant to extend the zone in which the interior means do not operate, which detracts from the effectiveness of the protection.

The enclosure is usually open, at least during the day, to allow natural ventilation, visual contact with the street, the garden areas or relaxation areas. It is in these conditions that the second level of protection falls.

For an owner who prefers such openness to the outside, all that remains therefore is the peripheral detection to satisfy the comfort of the members of his family present in the dwelling while providing for their security. But it is then necessary that such detection be designed to trigger alarms and sirens immediately when any movement appears on the periphery, in order to obtain by deterrence what the protection has lost due to the partial or total openness of the enclosure.

So the result again is sufficient false alarms caused by passing animals, the arrival of neighbors, repairmen, delivery men or door-to-door salesmen for this system to be quickly abandoned.

The aim of the invention is to provide a remedy for these shortcomings by proposing a solution by which the protection of property can be reconciled with the comfort and tranquility of the occupants of a premises.

The invention can also be used to leave premises partially open in the absence of its owners, and/or to simulate their presence. It can also be used to lock a door or a bay window that is closed but not locked.

The invention relies on the combination of peripheral sensors, in particular volumetric, and a device for the motorized control of closure elements, such as windows, doors or shutters.

Many patents describe security systems involving sensors for the detection of presence or movement and the control of actuators moving a closure element.

These patents in particular concern the protection of persons, to avoid, for example, an automatic door or a shutter injuring a user in its closing motion.

They also describe means causing the door to open when a client or a user approaches, in the case of commercial or public premises.

These patents all combine security with the detection of obstacles during a closing operation and in this case introduce a stopping or reopening function.

It is known, for example through U.S. Pat. No. 4,563,625 which discloses a device representative of this protection concern. In this patent is also disclosed the possibility of adjusting the door's opening position, but no provision is made for a semi-closed position allowing the passage of air.

In a non-conventional manner, U.S. Pat. No. 4,360,801 describes the association of a garage door actuator with a carbon monoxide sensor, so as to cause opening if the gas level exceeds a safety limit, but no provision is made for a partially closed position.

U.S. Pat. No. 5,003,290 describes a system incorporating the anti-intrusion alarm and access control functions. This system enables the electrical opening and closing of one or more locks, but it does not introduce a scenario of partial closing of a closure element.

U.S. Pat. No. 5,920,270 describes the problematics of the anxiety of alarm users, or the reluctance of owners to install such devices due to the complexity of the alarm arming or disarming procedures. It does not provide for several protection scenarios.

Although very comprehensive in the field of arming and disarming procedures for alarmed zones, although providing interior or perimeter detection, although providing for gradual action on actuators (such as, for example, sirens used at very low volume as an acknowledgement-of-receipt signal), U.S. Pat. No. 4,918,717 does not provide in its security device for the operation of actuators of certain closure elements.

U.S. Pat. No. 4,755,792 describes a combined system of security and control, in which a transmission by carrier currents is used between sensors and actuators. These actuators are lamps or household equipment or alarm sirens. The system provides for three main operating modes: an instantaneous armed mode, a delayed armed mode and a disarmed mode.

The delayed armed mode corresponds to the non-instantaneous triggering of the alarm after detection to allow the legitimate occupant of the premises, if it is he who triggered the detection, to disarm the alarm before operation of the actuators.

SUMMARY OF THE INVENTION

The invention proposes a device associating at least one electrically actuatable mobile closure system, such as a door, roller shutter, window etc. with a presence or movement sensor normally placed on the periphery of the zone to be protected, and a programming and control device the program of which comprises at least one surveillance mode and means of transition to that mode, wherein, when placed in surveillance mode, the programming and control device delivers a complete closure command on activation of the presence or movement sensor.

According to an additional feature, the device comprises a plurality of mobile closure, or locking, elements, each of which is electrically controlled by an actuator and once placed in surveillance mode, the programming and control device delivers, to at least one of the actuators, a complete closure command on activation of at least one of the sensors.

According to another feature, the transition to surveillance mode is caused by the pressing of a specific button on a remote control.

We should add that when placed in surveillance mode, the programming and control device delivers to the actuator, or to at least one of the actuators, a partial closure command.

Furthermore, the sensor or sensors are presence or movement sensors, or sensors of load or of movement of the closure element, or even meteorological sensors.

Other features and advantages of the invention will emerge from the description that follows with regard to the appended drawings, which are given as nonlimiting examples only.

DETAILED DESCRIPTION OF THE PREFERRED EMBODIMENTS

Figure 1:
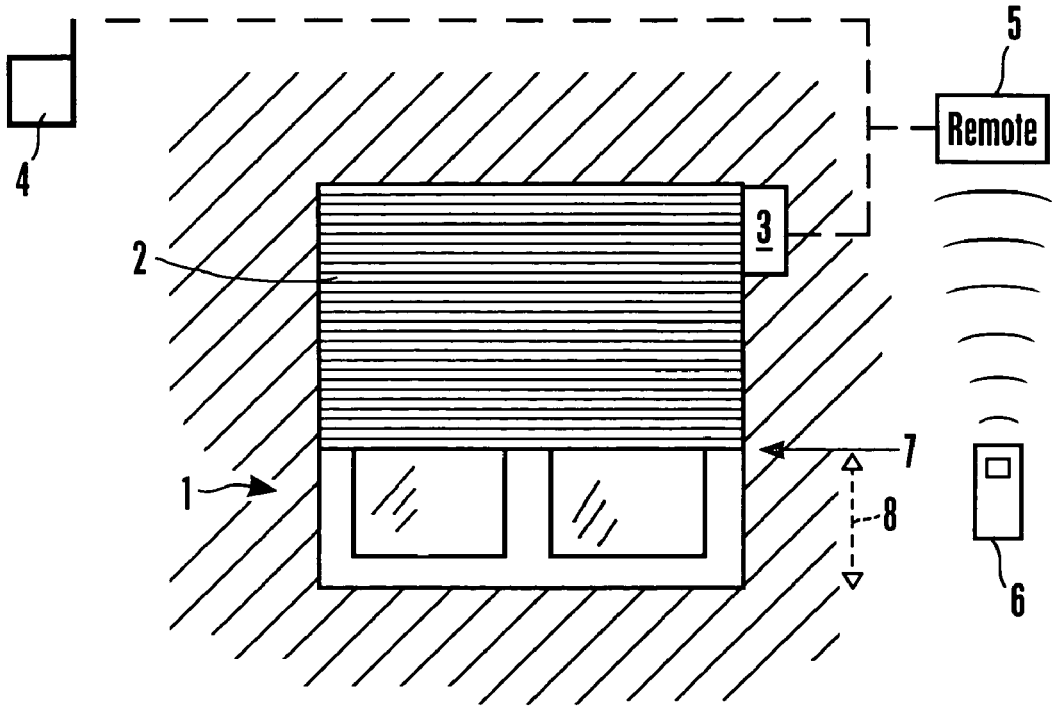
FIG. 1 represents a window fitted with a roller shutter controlled by the device of the invention.

A first example for a thorough understanding of the invention is that represented in FIG. 1.

In this exemplary embodiment, provision is made for a window (1) fitted with a roller shutter (2) that can be moved upward or downward by means of an actuator, such as an electric motor (3). Via a radio or wired link, the actuator (3) receives its commands from a control device (5), which may contain several management programs.

The control device (5) will naturally be capable of recognizing a closure command transmitted by the key (6) and of activating the actuator (3) in consequence, so that the shutter motor is activated.

But the assembly is designed such that the key (6) can transmit at least one particular command, here called a surveillance command.

The surveillance setting, to surveillance mode, consists in retaining the essential part of the openings in a position of aeration or of maximum vision, these positions being defined commensurate with a rapid closure if the need is felt.

For example, on receipt of a surveillance setting order, the control device (5) will give the command to the actuator (3) to close the shutter until it is in a defined semi-closed position (7) called the "surveillance idle position". In this position, the shutter is, for example, 20 cm from its closed position. If the window is open, good ventilation is thus assured.

If it is a shutter with perforations, the position (7) may be the bottom closed position. In this position, the view is assured from the interior through the perforations of the strips, which also provide ventilation.

If peripheral presence is detected by a sensor (4), the control device (5) gives the command for complete closure of the shutter, but without triggering the alarm actuators. The sensor information (4) may advantageously also be transmitted by the control device (5) to the key (6) to discreetly warn its holder of an active detection. As is known, the control device (5) may, for example, indicate the location of the detection on a screen.

Thus, unlike the devices of prior art, the deterrence provided by a closed enclosure becomes applicable to a dwelling or premises that is as open as possible.

It is clear that, when placed in surveillance mode and after detection of peripheral presence, the device (5) will interpret as a real break-in attempt any impediment noted in the downward motion of the shutter, along the length of its travel (8) between the surveillance idle position (7) and the complete closure position, if that downward motion is caused by a detection on the sensor (4). The detection will then be passed on to the alarm actuators (siren, etc.).

The same concept may also be applied to windows, such as motorized sliding bay windows.

Figure 2:
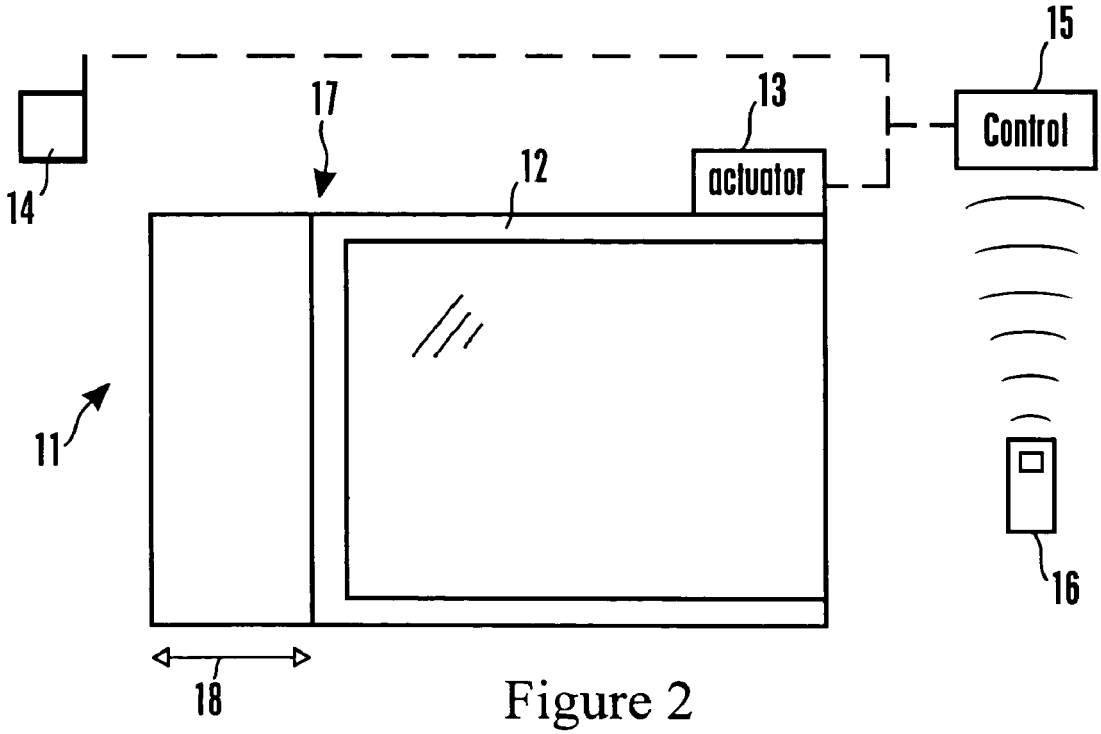
FIG. 2 represents a sliding bay window controlled by the device of the invention.

FIG. 2 gives an exemplary embodiment on a sliding bay window (11) with one mobile panel (12). We find the same elements as above, that is a remote control or security key (16), a control device (15), a sensor (14), an actuator (13), a defined surveillance idle position (17).

As a matter of prudence, when we switch to surveillance mode, the sliding mobile panel (12) will be positioned by the control device (15) in a semi-closed position (17), called the "surveillance idle position", ensuring good ventilation but leaving insufficient room for an intrusion. The travel (18) of the transition from the surveillance idle position to the closed position is therefore reduced in consequence.

In the case of a window of the pivoting/casement type, the open position is, in fact, an inclined position of one of the casements, leaving insufficient room for an individual to pass through. In these conditions, if a window of this type is used, the transition to surveillance mode keeps the window in the open position. Closure is activated only when there is a detection by the sensor.

Naturally, several actuators can share the resources of a single control and programming device and/or of a single sensor or a plurality of sensors.

In a "security" mode, all the closure elements accessible to a criminal shall be placed in the closed and locked position.

However, in a "surveillance" mode, which is an intermediate operating mode between the disarmed mode and the "security" mode, the invention proposes that first elements be kept open, whereas second elements be closed and locked, and that third elements be placed in a partial closure position, defined in advance.

The choice of the different elements or group of elements is determined by the manufacturer of the system, or by the installer, or by the user with the aid of the control and programming device. This device is presented, for example, in the form of a console with keyboard and screen.

Figure 3:
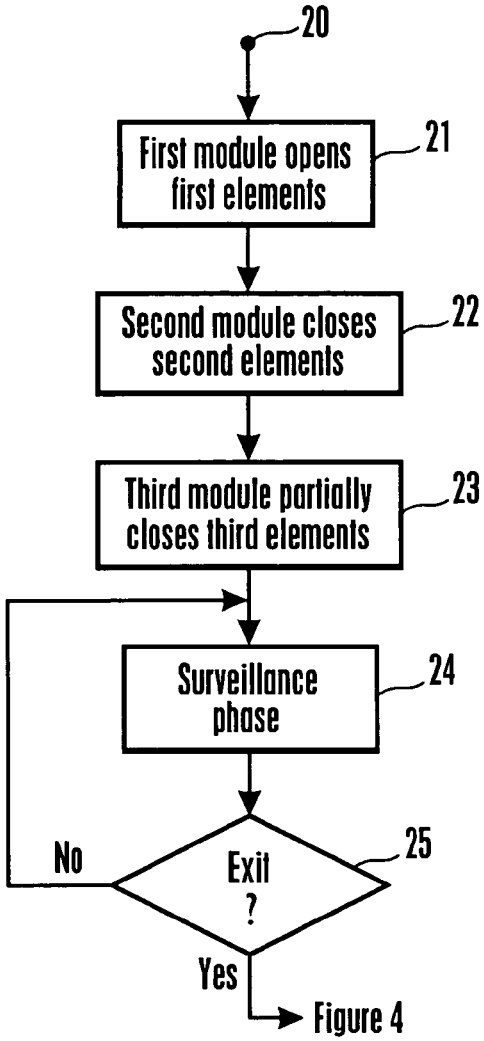
FIG. 3 thus details a software form of execution when several closure elements cooperate in the security and surveillance functions.

FIG. 3 illustrates a software form of execution in the case where several closure elements cooperate in the security and surveillance functions. This program is integrated in the whole supervisor program of the control and programming device.

The point of entry (20) into surveillance mode is reached if the supervisor program detects that the key (6, 16) has given an command to move to surveillance mode, or if the supervisor program has been placed in a specific "clock" mode. In this latter case, it is possible, during an absence of several days, to have the surveillance mode activated during the day and security mode activated during the night.

The first software module (21) then proceeds to open the first elements.

The second software module (22) then proceeds to close the second elements and where appropriate to lock them.

The third software module (23) proceeds with the partial closure of the third elements.

We then enter the surveillance phase itself, illustrated by the fourth software module (24).

Figure 4:
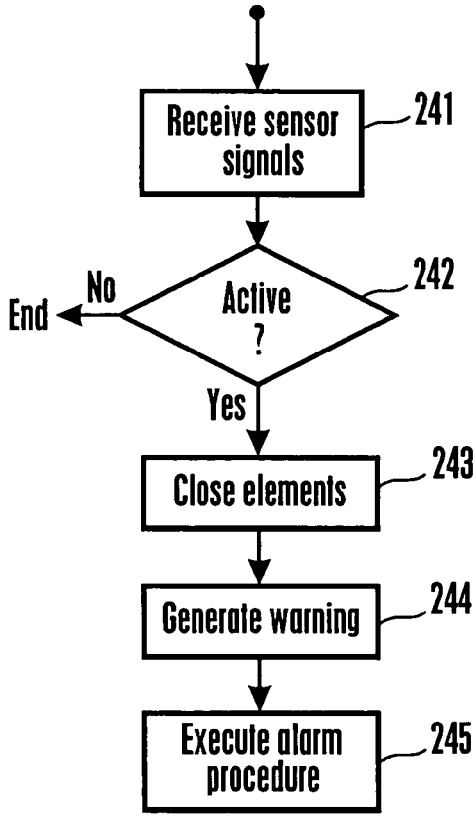
FIG. 4 illustrates a software variant.

This fourth software module is itself organized as sub-modules that can be produced by those skilled in the art and that are detailed in FIG. 4.

Lastly, the fifth software module (25) tests whether it is appropriate to exit from surveillance mode.

An exit from surveillance mode may be caused by an command to move into another mode transmitted by the key (6, 16) or by the programming clock.

In FIG. 4, the first software sub-module (241) is for acquiring the state of the sensor or sensors (4, 14). The second test software module (242) allows exit if these sensors are not active. If one of the sensors is active, the third sub-module (243) proceeds to completely close the second and third elements, either in totality, or on the appropriate facade only, or near the activated sensor, this choice being configurable in the control and programming device.

The fourth sub-module (244) is for sending a warning signal to the key (6, 16) and for displaying the location of the detection on a screen or indicator lamps.

Lastly, the fifth sub-module (245) is for engaging an alarm procedure (sirens and/or telephone calls) if an obstacle is detected during the complete closure motion.

The invention also makes provision for some or all of the sensors (4, 14) to consist of means of detection of load and/or motion on the closure elements, or disposed on the kinematic linkage comprising the motor and the closure element.

Lastly, the invention makes provision for other types of sensors, for example, meteorological (wind, rain, sun, etc.), to be used to enable the complete closure of certain closure elements according to those parameters when in surveillance mode.

It is understood that, by virtue of the device of the invention, when a detection is made during surveillance mode, the partially open shutters or openings will be automatically closed, whereas doors that are closed but not locked will be automatically locked.

Naturally, the invention is not restricted to the embodiments described and represented by way of example, but also includes all technical equivalents as well as their combinations.

The invention claimed is:

1. A device of automated closure, comprising:

at least one closure element for closure of a dwelling;

at least one electrically controllable actuator for operating said closure element;

at least one sensor for sensing a human presence or movement outside of said dwelling; and at least one programming and control device having at least one surveillance mode that is maintained, the closure element being maintained in an idle position in the surveillance mode, and means to transition to the surveillance mode, wherein when placed in surveillance mode, the programming and control device delivers a complete closure command to the actuator when a human presence or movement is detected by the at least one sensor.

2. The device of claim 1, comprising a plurality of mobile elements, each of which is electrically controlled by a respective actuator, wherein when place in the surveillance mode, the programming and control device delivers to at least one of the actuators a complete closure command in response to a signal from the sensor.

3. The device of claim 1, wherein the transition to surveillance mode is caused by the pressing of a button on a remote control.

4. The device of claim 1, wherein, when placed in surveillance mode, the programming and control device delivers to the actuator a partial closure command.

5. The device of claim 1, wherein in the surveillance mode fluid may flow through the closure element.

6. The device of claim 5, wherein in the surveillance mode human passage through the closure element is substantially blocked.

7. The device of claim 6, wherein the device is useful for locking the closure and wherein when in the surveillance mode, the programming and control device delivers, after complete closure, a locking command in response to a signal from the sensor.

8. The device of claim 1, wherein the device is useful for locking the closure and wherein when in the surveillance mode, the programming and control device delivers, after complete closure, a locking command in response to a signal from the sensor.

9. The device of claim 1, wherein the closure element is selected from the group consisting of: pivoting windows, sliding windows, roller shutters.

10. The device of claim 1, wherein the device also includes a sensor for sensing the load and/or movement of the closure element.

11. The device of claim 1, wherein the device also includes a sensor for sensing meteorological conditions.

12. The device of claim 1 wherein the idle position is a semi-closed position.

13. The device of claim 1 wherein the idle position is an open position.

14. The device of claim 1, comprising a plurality of mobile elements, each of which is electrically controlled by a respective actuator, wherein when placed in the surveillance mode, the programming and control device keeps open elements of a first type, closes and locks elements of a second type and maintains partially open elements of a third type, defined in advance.

15. The device of claim 1, comprising a security mode wherein the closure element is closed and locked, and comprising a clock mode in which the surveillance mode is activated during the day and the security mode is activated during the night.

16. The device of claim 1, comprising alarm actuators, wherein the alarm actuators are not triggered if a peripheral presence is detected by the sensor.

17. The device of claim 1, comprising means for engaging an alarm procedure if an obstacle is detected during the complete closure.

18. The device of claim 1, comprising a remote control wherein a sensor information is transmitted to the remote control to discretely warn of an active detection.

19. A system for controlling entry through a portal in a structure, composing:

at least one portal closure juxtaposed with the portal;

at least one sensor;

at least one actuator coupled to the portal closure to move the portal closure; and at least one processing device connected to the actuator for control thereof, the processing device receiving signals from the sensor, the processing device selectively establishing and maintaining a partially open configuration of the portal closure under a surveillance condition, wherein fluid may flow through the portal but human passage through the portal is substantially blocked, the processing device establishing a closed configuration of the portal closure to substantially block the portal in response to a predetermined signal from the sensor.

20. A system for controlling entry through a portal in a structure, comprising:

portal closure means for selectively blocking the portal;

sensing means for sensing motion in the structure;

actuation means for moving the portal closure means; and processing means for controlling the actuation means in response to signals from the sensing means, the processing means selectively establishing a partially open configuration of the portal closure means under a surveillance condition, wherein fluid may flow through the portal but human passage through the portal is substantially blocked, the processing means establishing a closed configuration of the portal closure means to substantially block the portal.

21. A device of automated closure, comprising:

at least one closure element for closure of a dwelling;

at least one electrically controllable actuator for operating said closure element;

at least one sensor for sensing a peripheral human presence outside of said dwelling; and at least one programming and control device having at least one surveillance mode that is maintained and means to transition to the surveillance mode, wherein when placed in surveillance mode, the programming and control device maintains the closure element in a partially open configuration until a signal is received from the sensor and delivers a complete closure command to the actuator when a human presence is detected by the at least one sensor.

* * * * *